US006173557B1

(12) United States Patent
Kuei

(10) Patent No.: US 6,173,557 B1
(45) Date of Patent: Jan. 16, 2001

(54) TAPE-LEADING MECHANISM FOR AN AUTOMATIC PACKER

(75) Inventor: Li Pi Kuei, Tu-Cheng (TW)

(73) Assignee: Gin Dan Enterprises Corp., Taipei Hsien (TW)

( * ) Notice: Under 35 U.S.C. 154(b), the term of this patent shall be extended for 0 days.

(21) Appl. No.: 09/205,838

(22) Filed: Dec. 3, 1998

(51) Int. Cl.[7] ..... B65B 13/04
(52) U.S. Cl. ..... 53/589; 100/26
(58) Field of Search ..... 53/389.4, 389.2, 53/589, 582; 100/32, 26, 25, 8, 29

(56) References Cited

U.S. PATENT DOCUMENTS 2,995,080 * 8/1961 Larsson ..... 53/589
5,333,438 * 8/1994 Gurak et al. ..... 53/589 X

* cited by examiner

*Primary Examiner*—Linda Johnson
(74) *Attorney, Agent, or Firm*—W. Wayne Liauh

(57) ABSTRACT

Disclosed is a tape-leading mechanism for an automatic packer including a housing having a tape inlet provided at an upper portion thereof, a tape-storing roller set in the housing near the tape inlet, and a movable tape-feeding bridge interconnecting the tape-storing roller set and a tape-operating unit for automatically feeding a tape to the tape-operating unit which thereafter sends the tape to a tape rail for packing a package. The movable tape-feeding bridge downward extends into a lower tape-storing chamber when there is no tape to be fed to the tape-operating unit. And, when there is a tape to be threaded into the housing and led to the tape-operating unit, a push button can be depressed to rotate the tape-storing roller set and therefore move the tape-feeding bridge to a position interconnecting the tape-storing rollers and the tape-operating unit. After the tape is successfully led to the tape-operating unit, the tape-feeding bridge turns downward again to send the unused tape into the tape-storing chamber.

3 Claims, 7 Drawing Sheets

PRIOR ART FIG. 1

TAPE-LEADING MECHANISM FOR AN AUTOMATIC PACKER

BACKGROUND OF THE INVENTION

The present invention relates to a tape-leading mechanism for an automatic packer that allows an operator to handle tape-leading operation in a standing position and includes a movable tape-feeding bridge to enable timely controlled tape-feeding and tape-storing operations.

For all currently available automatic packers, one example of which is shown in FIG. 1, the tape-leading operation thereof must be handled by an operator in a squatting position, so that a tape 40 for packing can be extended into a housing 50 of the packer via an inlet 52 provided at a lower portion of a side wall 51 of the housing 50. The tape 40 is then fed into a tape-storing chamber 54 in the housing 50 by a tape-storing unit 53 that feeds the tape 40 in one fixed direction. The tape 40 in the tape-storing chamber 54 is manually led to a tape-operating unit 55 for sending the tape 40 into a tape rail 56, so that the packer is prepared for performing a packing operation.

In an automatic packer disclosed in an earlier invention of the applicant published under Taiwanese Patent Publication No. 85216683, a tape can be automatically instead of manually led by the tape-storing unit to the tape-operating unit which operates to send the tape into the tape rail. However, the entire operation still requires an operator to squat and thread the tape into the tape inlet. It is inconvenient and troublesome for the operator to squat before the tape can be threaded into the inlet, particularly when the operator is a heavy person, an invalid or a disabled person, or a female operator wearing a short skirt.

Moreover, the tape 40 is wound around a tape reel 57 with a rear end thereof attached to the reel 57 by an adhesive tape (not shown). In the case the rear end of the tape 40 is unexpectedly pulled away from the reel 57 and enters the route of tape in the housing 50, the adhesive tape attached to the rear end of the tape 40 would stick to rollers forming the tape-operating unit 55. The operator must remove the adhesive tape before the packer can operate again. This condition will, of course, cause inconvenience and troubles to the whole packing operation.

It is therefore tried by the applicant to develop a tape-leading mechanism for an automatic packer that allows an operator to conveniently complete a tape-leading operation on the packer in a natural standing position.

SUMMARY OF THE INVENTION

The tape-leading mechanism for an automatic packer according to the present invention includes a housing having a tape inlet provided at an upper portion of a side wall thereof, a tape-storing roller set provided at an inner side of the tape inlet, and a movable tape-feeding bridge interconnecting the tape-storing rollers and a tape-operating unit for automatically feeding a tape to the tape-operating unit which thereafter sends the tape to a tape rail for packing a package.

The movable tape-feeding bridge included in the present invention downward extends into a tape-storing chamber when it is in a normal state, that is, when there is no tape to be fed to the tape-operating unit. And, when there is a tape to be threaded into the housing of the tape-leading mechanism, a push button can be depressed to move the tape-feeding bridge to a position interconnecting the tape-storing rollers and the tape-operating unit. When the tape is successfully led to the tape-operating unit, the tape-feeding bridge turns downward again to send the unused tape into the tape-storing chamber.

A detector outside the housing is connected to a suitable point on the tape feeding route for detecting normal feeding of the tape. When a rear end of the tape passes the detector and is detected, it indicates that a whole reel of tape is used up. The tape-storing rollers are signaled to stop storing tape. And, when the tape in the tape-storing chamber is insufficient for use, the tape-storing rollers is caused to rotate in reverse direction to withdraw the remained tape.

BRIEF DESCRIPTION OF THE DRAWINGS

The features of the present invention can be best understood by referring to the following detailed description of the preferred embodiments and the accompanying drawings, wherein.

DETAILED DESCRIPTION OF THE PREFERRED EMBODIMENTS

Figure 2:
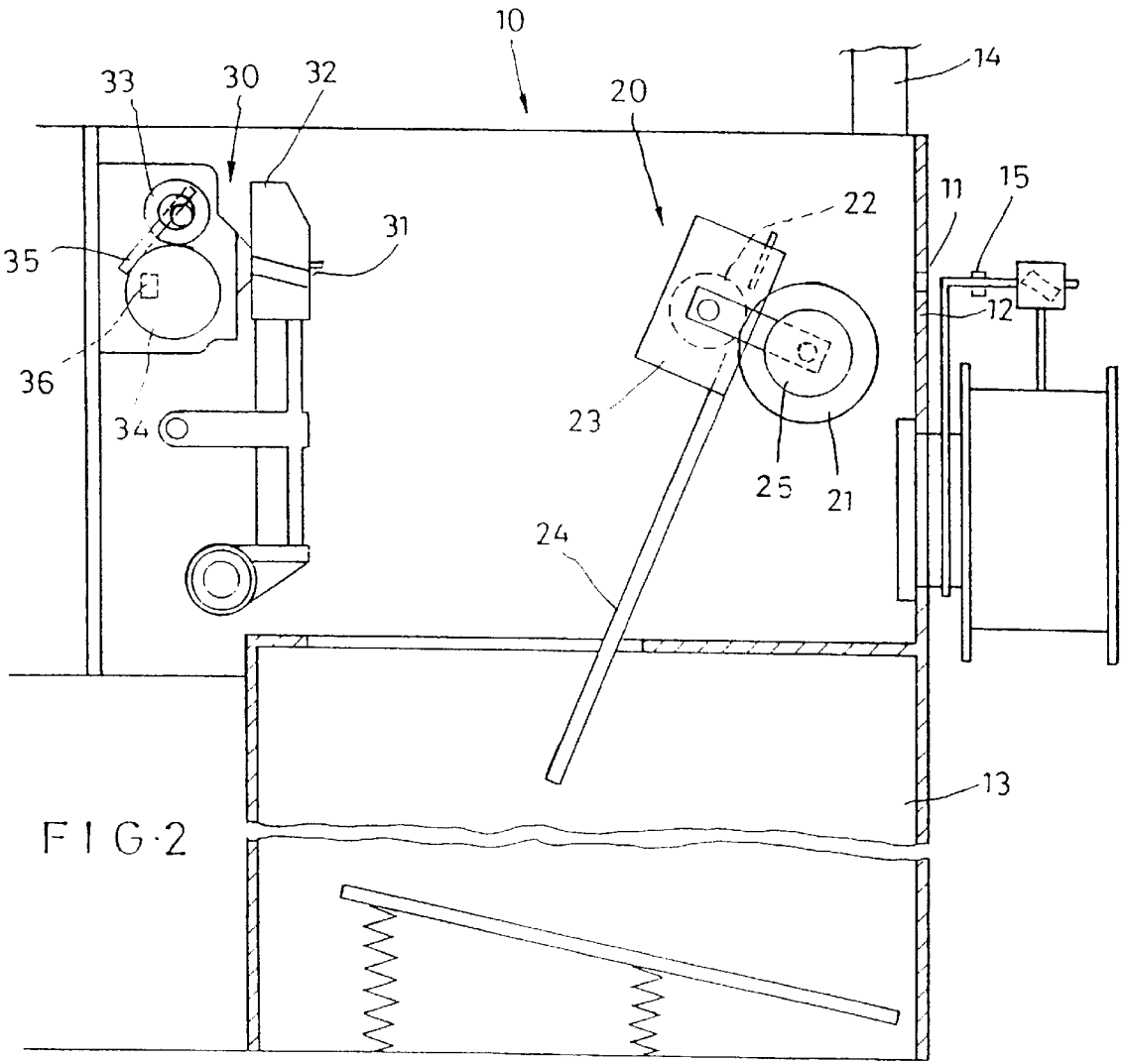
FIG. 2 illustrates a tape-leading mechanism for an automatic packer according to the present invention, wherein the mechanism is in a normal state without leading a tape therethrough.
Figure 3:
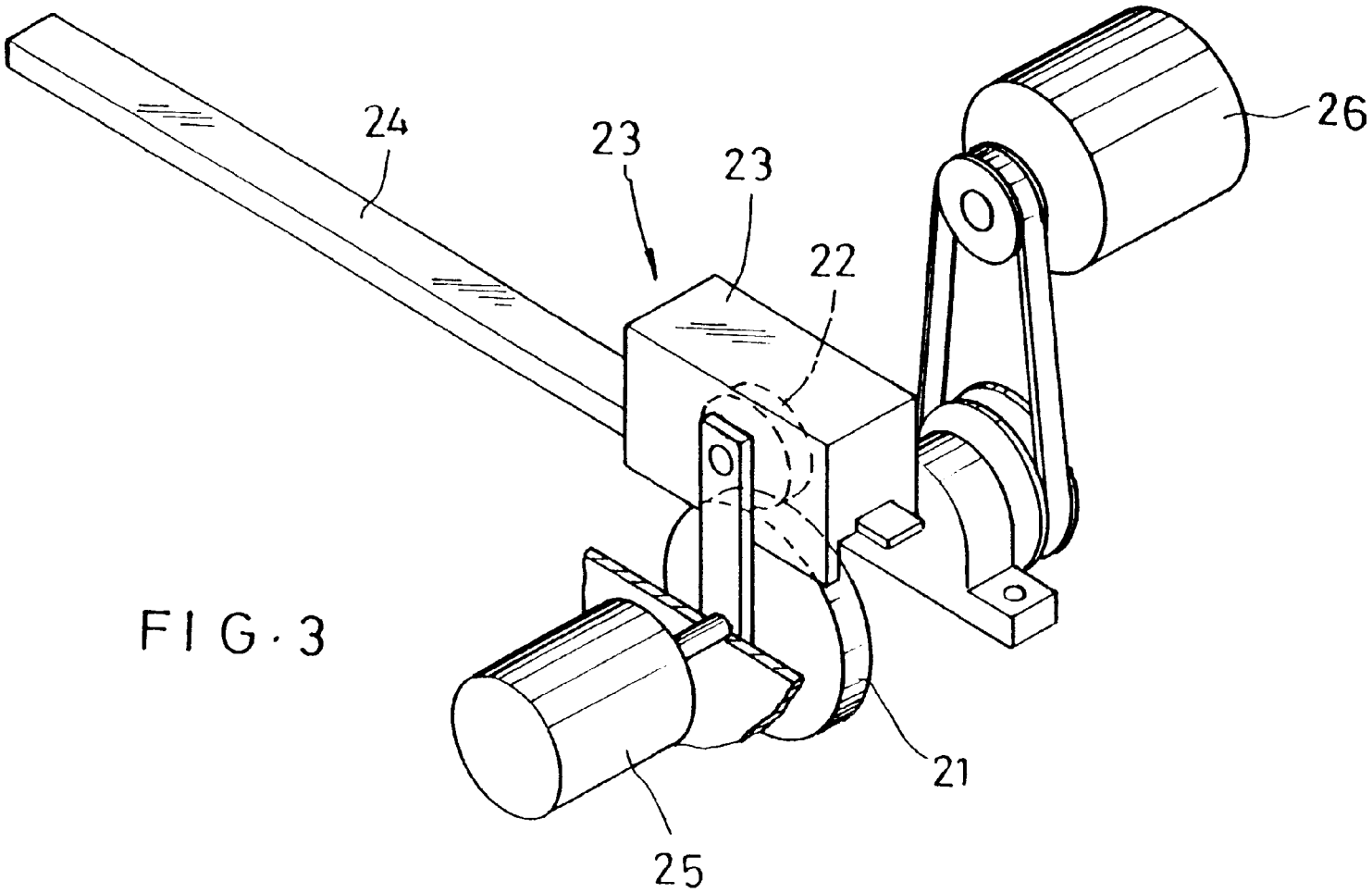
FIG. 3 is a perspective view showing the tape-storing roller set and the solenoid driving means included in the present invention.

Please refer to FIG. 2 that schematically illustrates a tape-leading mechanism for an automatic packer according to the present invention. The whole tape-leading mechanism includes a housing 10 in which a tape-storing roller set 20 is mounted. A tape inlet 11 is provided at an upper portion of a side wall 12 of the housing 10 near the tape-storing roller set 20. The tape-storing roller set 20, as can be more clearly seen from FIG. 3, mainly include a drive roller 21 driven by a power source 26 and a driven roller 22 closely contacting the drive roller 21. The driven roller 22 is mounted in and fixed to a frame 23 while the frame 23 is connected to a tape-feeding bridge 24. The frame 23 is driven to rotate by a solenoid screw rod 25, and a driving center of the screw rod 25 is located at the same axis as that of the drive roller 21, so that the driven roller 22 always closely contacts the drive roller 21 before, during and after he rotation of the frame 23. When the whole tape-leading mechanism is in a normal state, that is, when there is no tape to be fed to the tape-operating unit, the tape-feeding bridge 24 connected to the frame 23 extends a free end thereof down into a tape-storing chamber 13 at a lower part of the housing 10. And, when there is a tape to be led to a tape-operating unit 30 of the tape-leading mechanism, a push button can be depressed to actuate the solenoid screw rod 25 and thereby rotate the frame 23. At this point, the tape-feeding bridge 24 moves to point its free end toward a tape inlet 31 of the tape-operating unit 30 and finally interconnects the tape-storing roller set 20 and the tape-operating unit 30. When the tape-storing roller set 20 is actuated, the tape 40 is sent into a tape rail 14 from the roller set 20, the tape-feeding bridge 24, and the tape-operating unit 30. When the tape 40 is actually fed into the tape-operating unit 30, the solenoid screw rod 25 automatically stops rotating and the remaining tape 40 is sent back into the tape-storing chamber 13.

Figure 4:
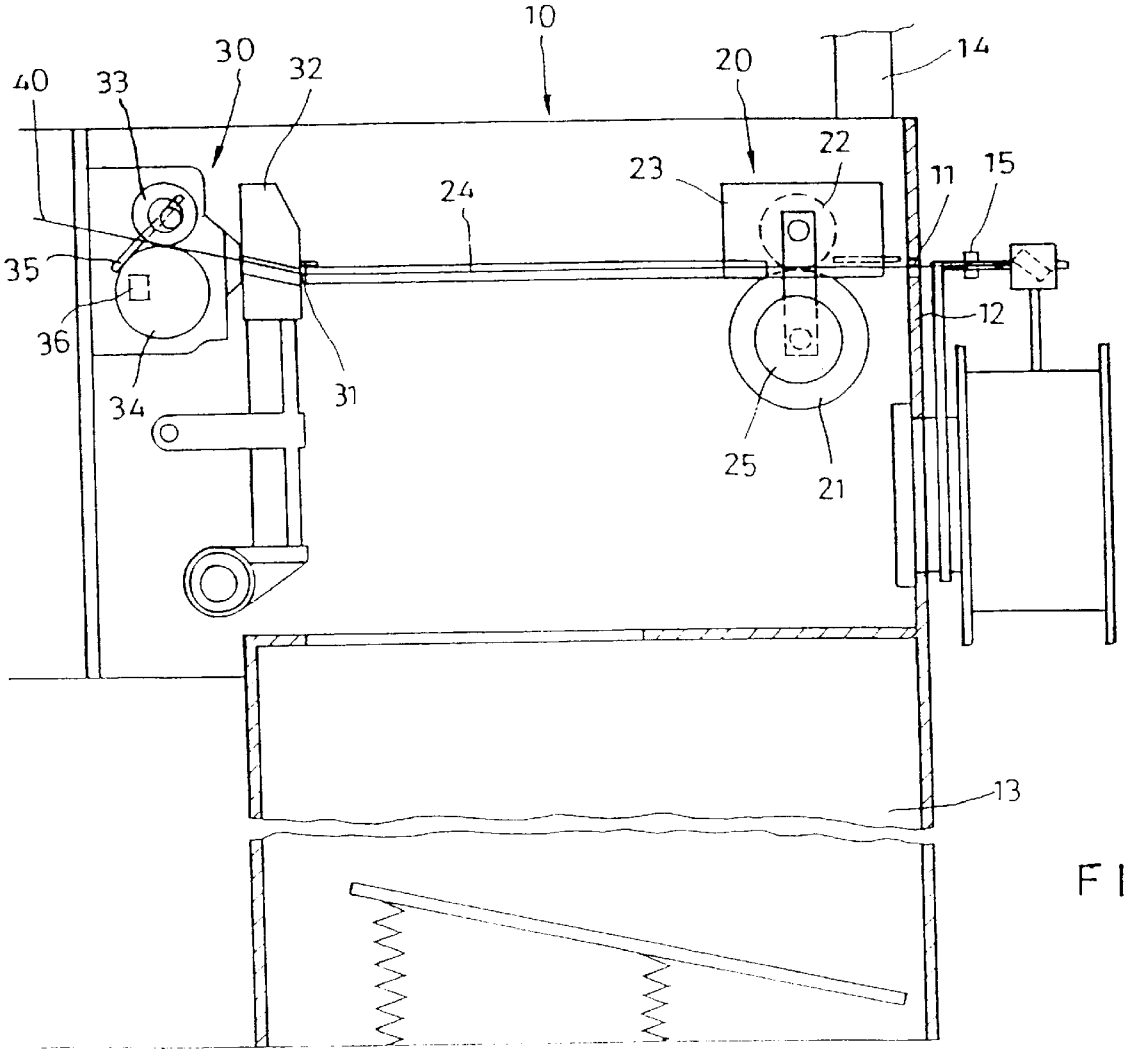
FIG. 4 illustrates the tape-leading mechanism of the present invention in a tape-leading state.
Figure 5:
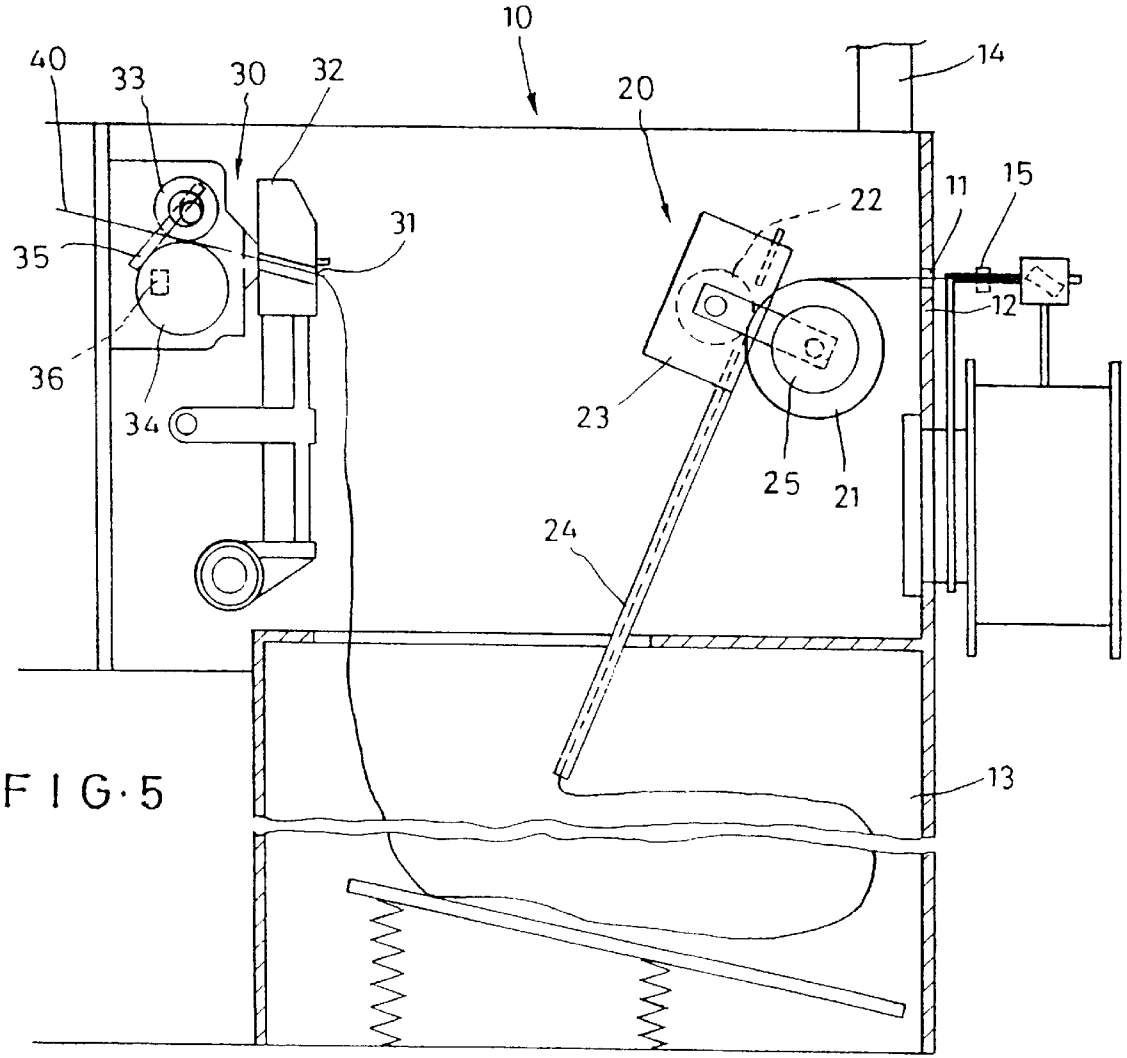
FIG. 5 illustrates the tape-leading mechanism of the present invention in a tape-storing state.
Figure 6:
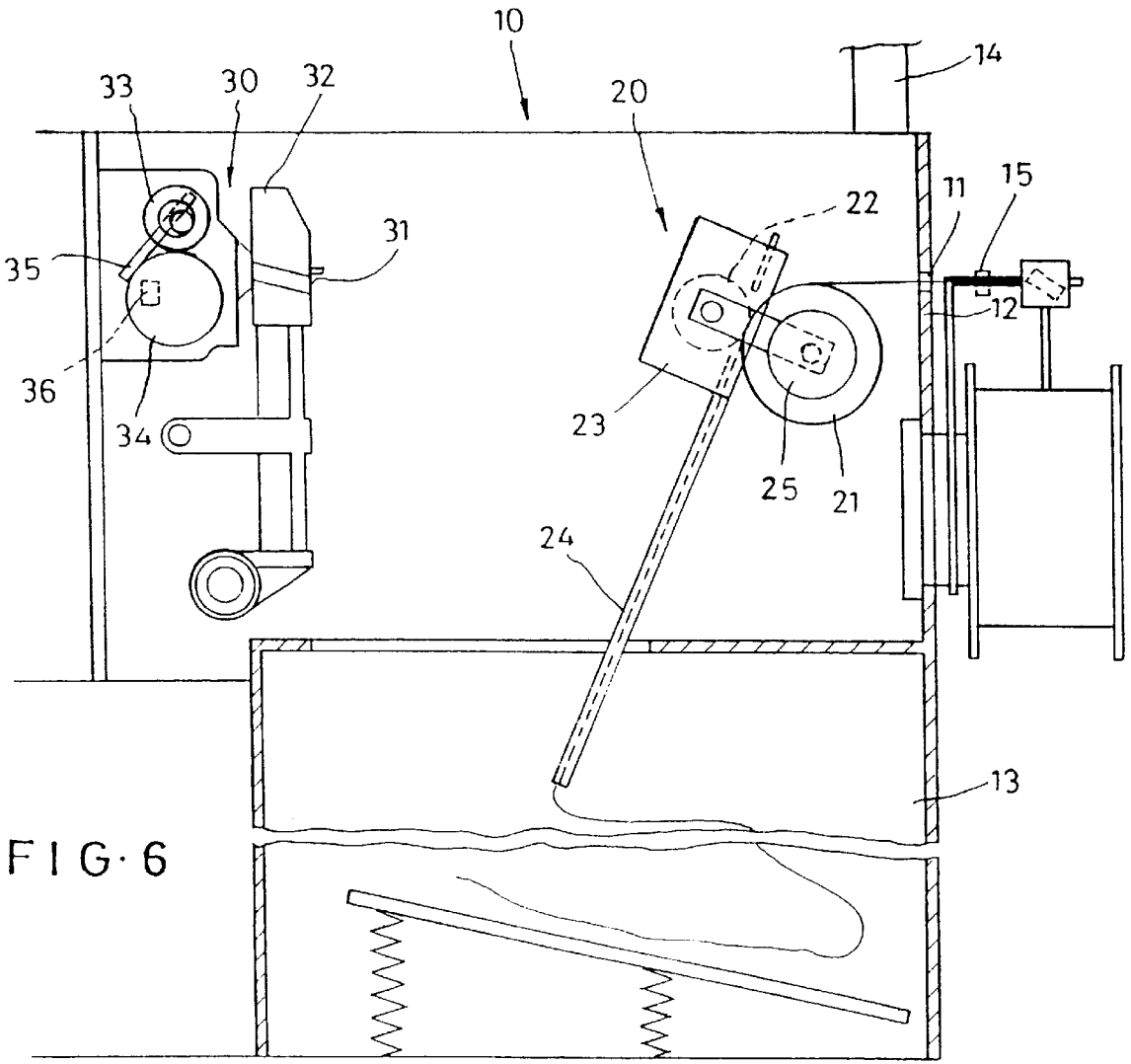
FIG. 6 illustrates the tape-leading mechanism of the present invention in a tape-withdrawing state.
Figure 7:
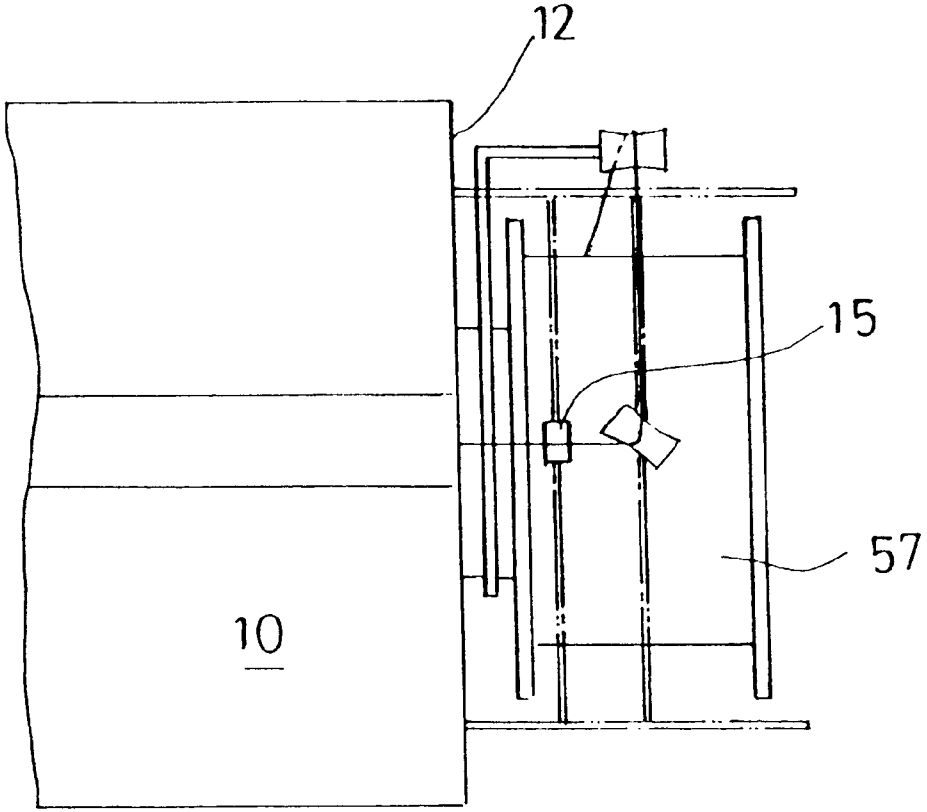
FIG. 7 is a fragmentary top view showing the tape reel located at outside the housing of the tape-leading mechanism of the present invention.

As shown in FIG. 2, the tape-feeding bridge 24 extends its free end slightly into the tape-storing chamber 13 and the frame 23 inclines downward before the tape-storing roller set 20 is actuated, so that the tape 40 not in use is sent into the tape-storing chamber 13. And, when the frame 23 is driven by the solenoid screw rod 25 to cause the tape-feeding bridge 24 to connect with the tape inlet 31 of the tape-operating unit 30, as shown in FIG. 4, the tape 40 is directly fed to the tape-operating unit 30 by the tape-storing roller set 20. The tape-operating unit 30 then leads the tape 40 into the tape rail 14 to prepare the automatic packer for packing a package.

Figure 1:
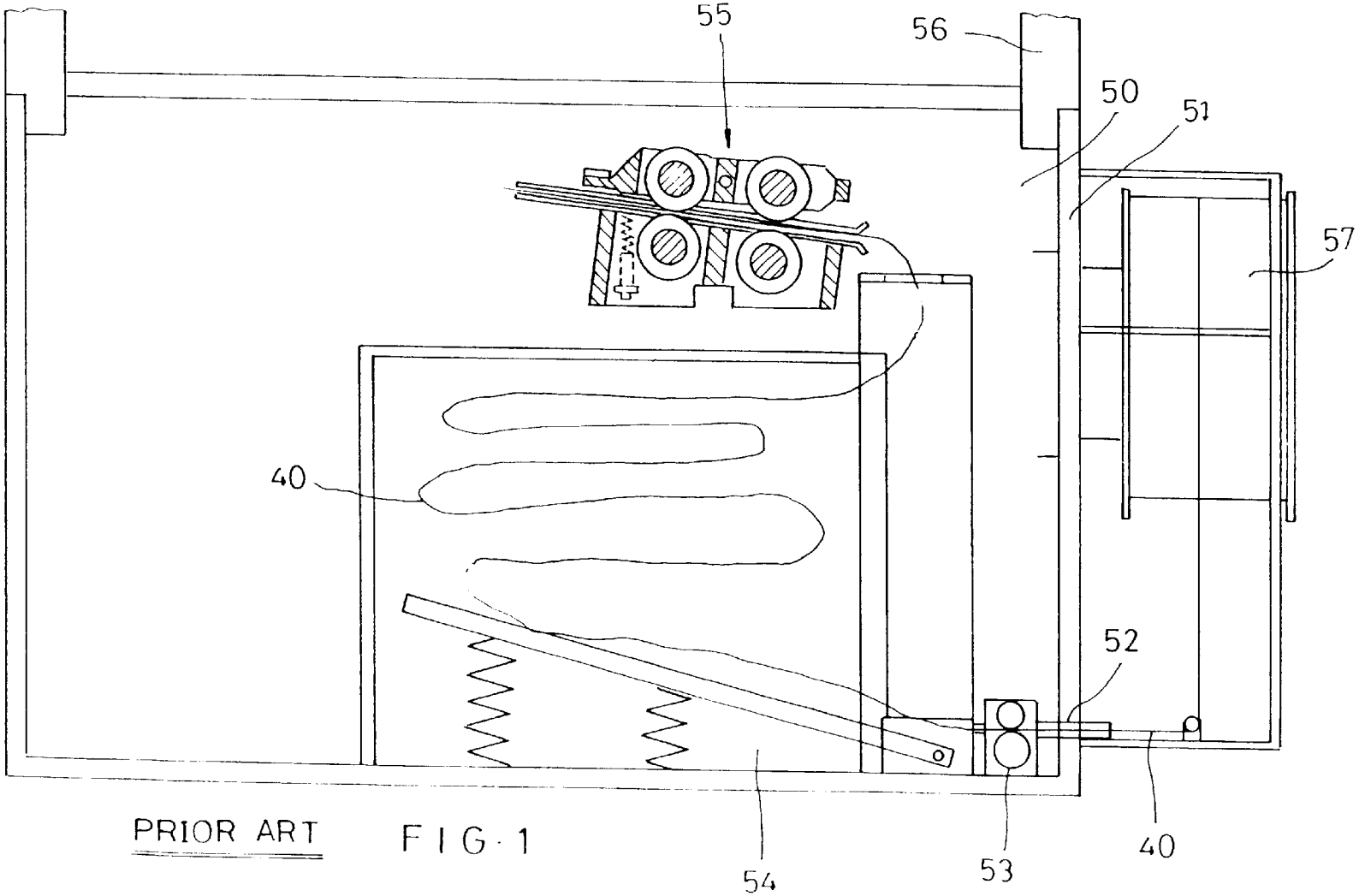
FIG. 1 illustrates a conventionally structured tape-leading mechanism for an automatic packer.

The tape-operating unit 30 may be of the type shown in FIG. 2 to have a rocking arm 32. The rocking arm 32 is intended mainly for performing a second time tightening of the tape 40. Alternatively, the tape-operating unit 30 may be the same as the tape-operating unit 55 as shown in FIG. 1. The tape-operating unit 30 further includes an eccentric wheel 33 closely contacts with a drive roller 34 located below it. A bar 35 is connected at an end to a shaft of the eccentric wheel 33, such that when the tape 40 is actually fed and clamped between the eccentric wheel 33 and the drive roller 34 of the tape-operating unit 30, a free end of the bar 35 turns by an angle that amplifies a rotating angle of the eccentric wheel 33 caused by a thickness of the tape 40 between the eccentric wheel 33 and the drive roller 34. An approach switch (or sensor) 36 may be provided to detect such movement of the bar 35 to correctly determine that the tape 40 has been actually fed into the tape-operating unit 30 and clamped between the eccentric wheel 33 and the drive roller 34. At this point, the solenoid screw rod 25 is signaled to stop its operation and the tape-feeding bridge 24 returns to its downward extended position. After the automatic packer completes the normal packing operation, the remaining tape 40 is sent back into the tape-storing chamber 13.

As mentioned above, when the tape-leading mechanism of the present invention is in a normal state, the tape-feeding bridge 24 extends downward into the tape-storing chamber 13. When the tape 40 wound around the tape reel 57 outside the housing 10 is to be led into the housing 10, the tape-feeding bridge 24 is moved via a push button to interconnect the tape-storing roller set 20 and the tape-operating unit 30. After the tape 40 is successfully led to the tape-operating unit 30, the tape-feeding bridge 24 is moved to turn downward to send the unused tape 40 into the tape-storing chamber 13.

A detector 15 may be connected to a suitable point on a tape feeding route outside the housing 10 for checking normal feeding of the tape 40. If no tape 40 is detected by the detector 15, it indicates the tape 40 wound around the tape reel 57 mounted outside the housing 10 has been used up. At this point, the tape-storing roller set 20 is braked and stopped to prevent a rear end of the tape 40 from entering into the housing 10.

There are times the remained tape 40 is not long enough for the tape-operating unit 30 to perform a complete packing and a front end of the tape 40 is completely fallen into the tape-storing chamber 13 when the tape 40 is withdrawn to tighten the package. At this point, the approach switch 36 detects that no tape 40 is clamped between the eccentric wheel 33 and the drive roller 34 of the tape-operating unit 30 and would signal the drive roller 21 of the tape-storing roller set 20 to rotate in reverse direction, so that tape 40 in the tape-storing chamber 13 insufficient for one complete packing can be fully withdrawn from the housing 10 to facilitate replacement of the empty tape reel with a new tape reel 57. With this arrangements, any adhesive tape (not shown) for fixing the rear end of the tape 40 to the tape reel 57 would not stick to or between the rollers 21 and 22 of the tape-storing roller set 20. No trouble for removing the adhesive tape from the rollers 21, 22 would be caused.

In conclusion, the tape-leading mechanism for an automatic packer according to the present invention has simple structure that not only allows an operator to easily and conveniently perform the whole tape threading and leading operation in a standing position but also prevents the rear end of the tape from entering into the housing of the mechanism to avoid failure of the whole mechanism.

What is claimed is:

1. A tape-leading mechanism for use with an automatic packer, comprising:

a housing, having an upper portion and a lower portion, said lower portion serving as a tape-storing chamber;

a tape inlet formed through a wall at one horizontal end of said upper portion, a tape-storing roller set provided near said tape inlet, and a tape-operating unit provided inside and near the other horizontal end of said upper portion, wherein said tape-storing roller set and said tape-operating unit are positioned at substantially the same horizontal level;

said tape-storing roller set comprising a drive roller and a driven roller, said driven roller being fixedly mounted to a frame and in close match with said drive roller so as to force a tape to travel therebetween, said tape-storing roller set further comprising a solenoid screw rod which causes said frame to rotate;

a tape-feeding bridge, having a first end fixedly mounted to said frame, and a second end extending horizontally across said upper portion of said housing so that when said frame is rotated up to a first position, said tape-feeding bridge connects between tape-storing roller set and an entrance of said tape-operating unit to guide a tape to travel from said tape-storing roller set to said entrance of said tape-operating unit, and when said frame is rotated down to a second position, said second end of said tape-feeding bridge is pivoted into said lower portion of said housing, allowing said tape to be stored in said lower portion of said housing.

2. A tape-leading mechanism for an automatic packer as claimed in claim 1, further comprising a sensor to detect whether said tape has been actually fed into and clamped between rollers of said tape-operating unit, said sensor signaling said solenoid screw rod to stop operating when said tape is detected in said tape-operating unit and signaling said solenoid screw rod to rotate in reverse direction to withdraw said tape from said housing when said tape in said tape-storing chamber is found insufficient for one complete packing.

3. A tape-leading mechanism for an automatic packer as claimed in claim 1, further comprising a detector connected to a suitable point on a tape feeding route outside said housing for checking normal feeding of said tape, and said tape-storing roller set being braked and stopped to prevent a rear end of said tape from entering into said housing if no tape is detected by said detector.

* * * * *